US006626197B2

(12) United States Patent
Lin et al.

(10) Patent No.: US 6,626,197 B2
(45) Date of Patent: Sep. 30, 2003

(54) MULTIPLE-FOLD AUTOMATIC UMBRELLA WITH SMOOTHLY WOUND MULTIPLE-ROPE

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 63 days.

(21) Appl. No.: 09/836,289

(22) Filed: Apr. 18, 2001

(65) Prior Publication Data

US 2002/0153032 A1 Oct. 24, 2002

(51) Int. Cl.[7] ..... A45B 25/14
(52) U.S. Cl. ..... 135/24; 135/22
(58) Field of Search ..... 135/22, 23, 24, 135/25.1, 25.3, 25.31, 25.32, 25.34, 37, 28

(56) References Cited

U.S. PATENT DOCUMENTS 5,492,140 A * 2/1996 Lin et al. ..... 135/24
5,617,889 A * 4/1997 Wu ..... 135/22
5,645,094 A * 7/1997 Wu ..... 135/24
6,016,822 A * 1/2000 Lin et al. ..... 135/24
6,415,805 B1 * 7/2002 Kuo ..... 135/22
6,422,250 B1 * 7/2002 Wu et al. ..... 135/24

* cited by examiner

*Primary Examiner*—Janet M. Wilkens
(74) *Attorney, Agent, or Firm*—Troxel Law Office PLLC

(57) ABSTRACT

A multiple-fold automatic umbrella includes: a central shaft; a rib assembly pivotally secured to an upper notch and a lower runner on the central shaft; an opening spring and a plurality of closing springs for opening or closing the umbrella; and a control device including a push button, an opening controller having an upper latch for controlling the opening of the umbrella, a closing controller including a lower latch for controlling the closing of the umbrella, and a multiple-fold rope respectively sinuously wound on a plurality of rollers which are respectively mounted on an upper holder formed on an upper portion of the central shaft adjacent to the upper notch and on a lower holder formed on the lower runner for smoothly winding the rope on the rollers for enhancing a smooth opening or closing operation of the umbrella.

1 Claim, 6 Drawing Sheets

MULTIPLE-FOLD AUTOMATIC UMBRELLA WITH SMOOTHLY WOUND MULTIPLE-ROPE

BACKGROUND OF THE INVENTION

A conventional multiple-fold automatic umbrella includes a rope wound on a plurality of rollers respectively mounted in an upper portion of a central shaft and a lower runner of the umbrella for providing an extending or retraction stroke of the rope of a controller for opening or closing the umbrella. Since the upper portion of the central shaft and the runner should be formed with channels therein to allow the rope passing through the channels when wound on the related rollers, it is very inconvenient to install the rope on the umbrella by passing the rope through the channels, increasing the production complexity of the umbrella. Meanwhile, the conventional umbrella is not provided with any guiding device or fastening device for well guiding the rope among the rollers or for well fastening a holder of the roller, thereby easily causing disorder or damage of the roller or rope system and influencing a smooth operation for opening or closing the umbrella.

The present inventor has found the drawbacks of the conventional automatic umbrella and invented the present invention with smoothly wound multiple-fold rope.

SUMMARY OF THE INVENTION

The object of the present invention is to provide a multiple-fold automatic umbrella including: a central shaft; a rib assembly pivotally secured to an upper notch and a lower runner on the central shaft; an opening spring and a plurality of closing springs for opening or closing the umbrella; and a control device including a push button, an opening controller having an upper latch for controlling the opening of the umbrella, a closing controller including a lower latch for controlling the closing of the umbrella, and a multiple-fold rope respectively sinuously wound on a plurality of rollers which are respectively mounted on an upper holder formed on an upper portion of the central shaft adjacent to the upper notch and on a lower holder formed on the lower runner for smoothly winding the rope on the rollers for enhancing a smooth opening or closing operation of the umbrella.

DETAILED DESCRIPTION

Figure 1:
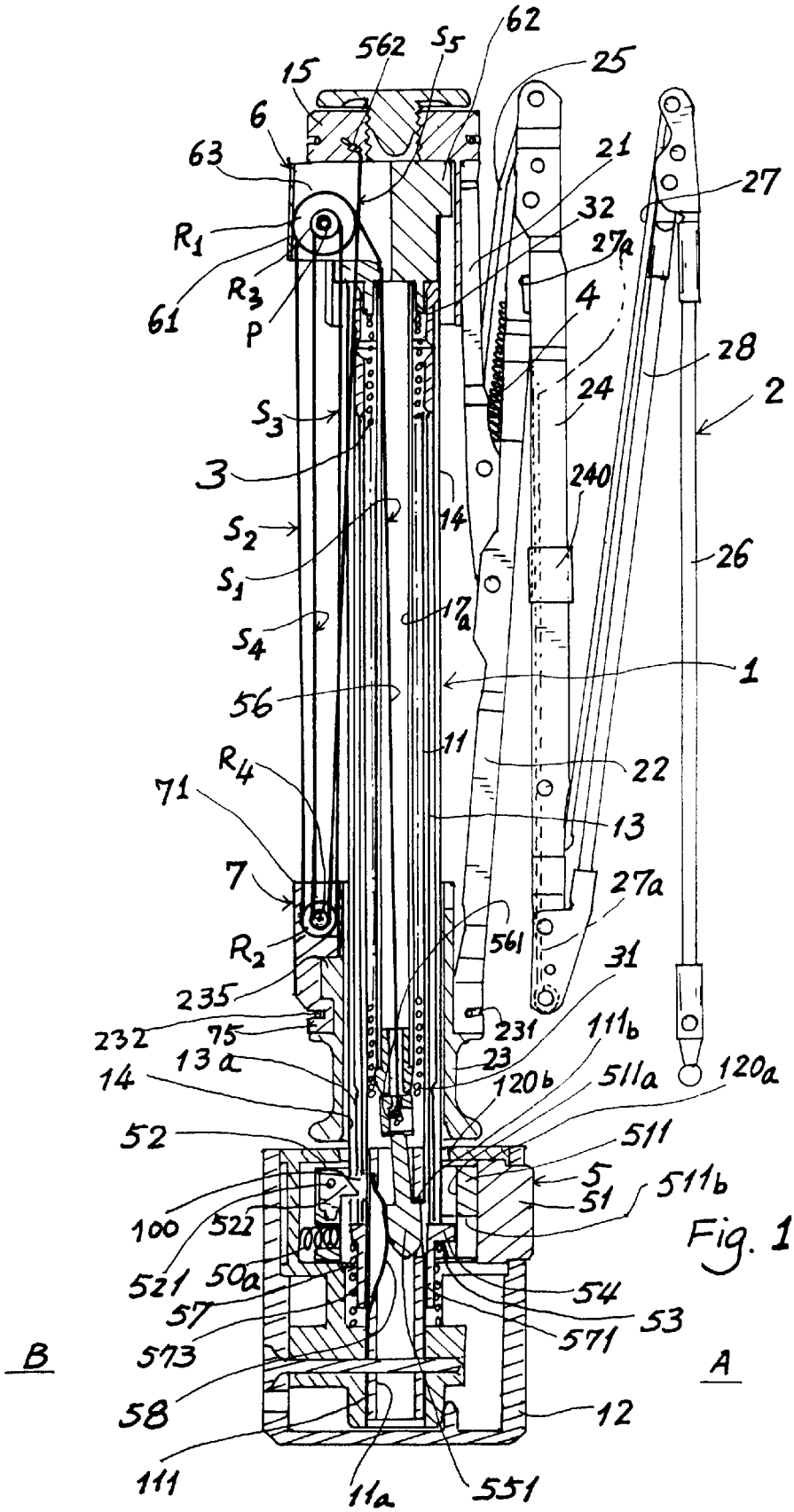
FIG. 1 is an illustration when closing the umbrella of the present invention.
Figure 2:
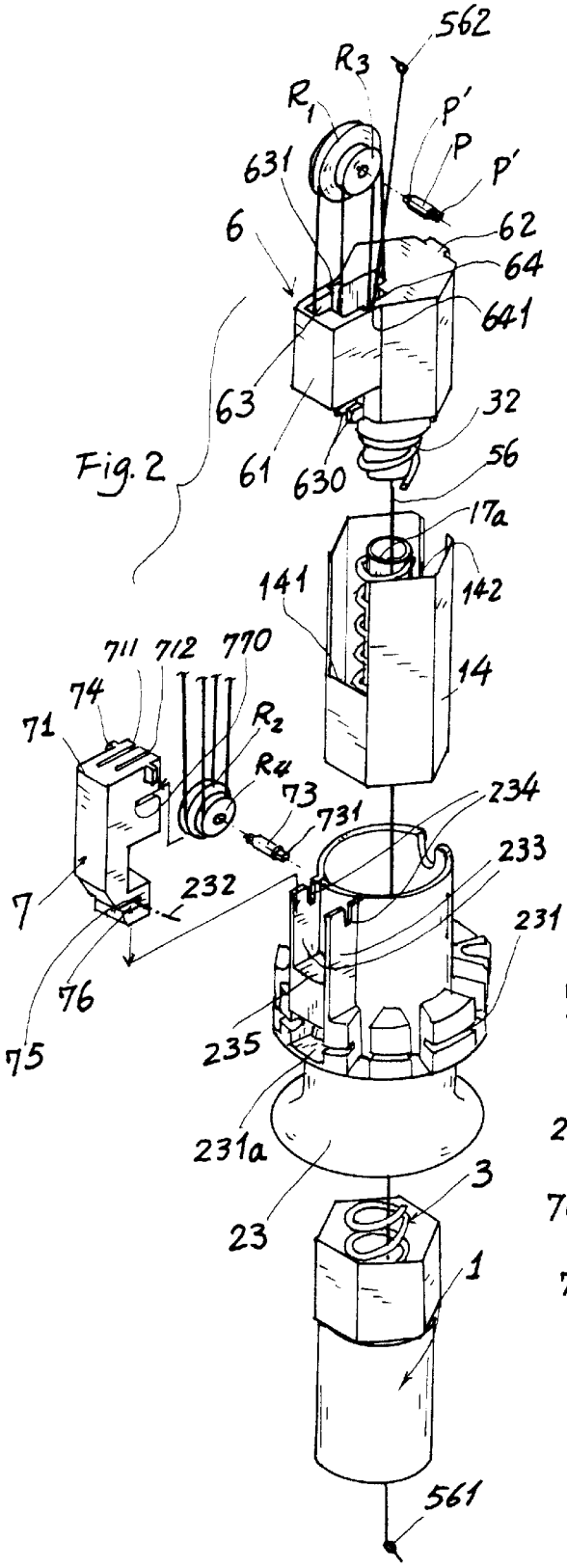
FIG. 2 is an exploded view showing the elements of the rope and rollers of the present invention.
Figure 3:
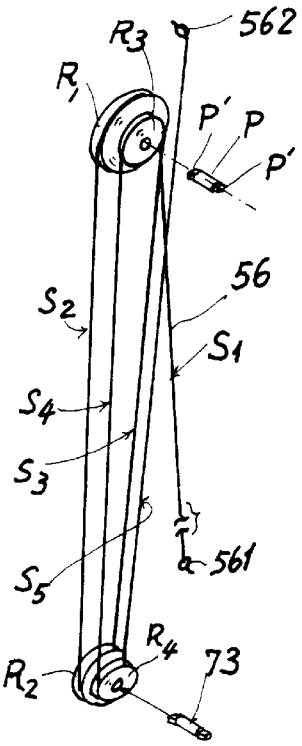
FIG. 3 shows the winding of the rope on the rollers of the present invention.
Figure 4:
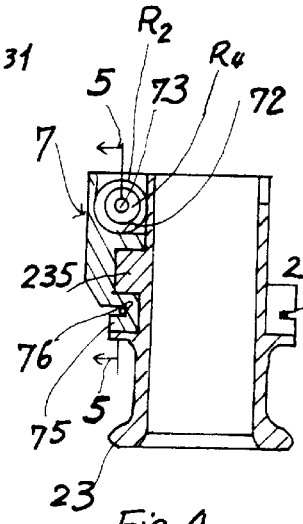
FIG. 4 is a sectional drawing of the runner of the present invention.
Figure 5:
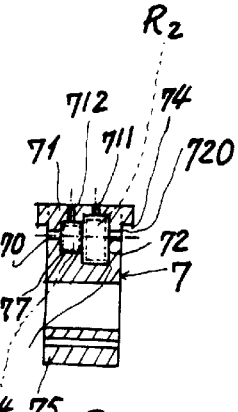
FIG. 5 is an illustration as viewed from 5—5 direction of FIG. 4.

As shown in FIGS. 1~5, the present invention comprises: a central shaft 1, a rib assembly 2, an opening spring 3 formed in the central shaft 1, a plurality of closing springs 4 formed on the rib assembly 2, a control means 5, an upper roller holder 6 and a lower roller holder 7.

The central shaft 1 includes: a lower tube 11, a grip 12 secured to a lower portion 111 of the lower tube 11, a first middle tube 13 telescopically engageable with the lower tube 11, a second middle tube 13*a* telescopically engageable with the first middle tube 13, an upper tube 14 telescopically engageable with the second middle tube 13*a*, an upper notch 15 formed on a top end of the shaft 1, and a central sleeve 17*a* secured to the upper roller holder 6 formed in a top portion of the shaft 1, thereby forming a quadruple-fold central shaft 1 consisting of four tubes 11, 13, 13*a* and 14.

The rib assembly 2 includes: a top rib 21 pivotally secured to the upper notch 15, a stretcher rib 22 pivotally secured to the top rib 21 and a lower runner 23 slidably held on the shaft 1, an intermediate rib 24 made of plastic materials and pivotally secured to the stretcher rib 22 and also pivotally secured to the top rib 21 by means of an inner connecting rib 25, a tail rib 26 pivotally secured to the intermediate rib 24 respectively through an outer connecting rib 28 and an outer spring rib 27, and an inner spring rib 27*a* pivotally secured between the stretcher rib 22 and the outer connecting rib 28 with the inner spring rib 27*a* slidably held to the intermediate rib 24 by a ring 240 secured on the rib 24, thereby forming a quadruple-fold rib assembly. Naturally, the present invention is not limited to merely quadruple-fold and may be any multiple folds.

The control means 5 includes: a push button 51 slidably held in a button hole 12*h* adjacent to a front side A of the grip 12; an upper latch 52 having a sloping latch portion 522 and made of metal including steel and other strong materials secured (by a pin 521) on a rear portion of a sliding ring member 511 which is slidably held in a sliding groove 120*a* formed in a bottom plug 120 fixed in the grip 12; a tension spring 50*a* secured in the bottom plug 120 adjacent to a rear side B of the grip 12 for resiliently urging the sliding ring member 511 and the push button 51 forwardly ready for a depression of the push button 51, with the tension spring 50*a* resiliently urging the upper latch 52 for engaging an engaging hole 100 formed in the middle tube 13*a*, 13 and in the upper tube 14 for "locking" the tubes of the shaft 1 when lowered through a central ring hole 511*a* formed in the ring member 511 for closing the umbrella as shown in FIG. 1; a closing controller 53 having a lower latch 54 resiliently secured to an elongate cylinder 571 of an anti-false operation safety means 57 resiliently slidably held in the bottom plug 120 as upwardly urged by a tension spring 573, whereby upon inward depression on the push button 51 when opening the umbrella, the ring member 511 will be pushed rearwardly to disengage the upper catch 52 from the engaging hole 100 formed in the tubes 14, 13*a*, 13 for opening the umbrella and to allow a latch slot 511*b* formed in a front bottom portion of the ring member 511 for receiving the lower latch 54, an upward rising of the lower latch 54 will be retarded by the ring member 511 to prevent a false operation as accidentally depressing the lower latch 54 during the operation for opening the umbrella; and a penta-fold rope 56 having five rope sections S1~S5 with an inner rope end 561 and an outer rope end 562 respectively secured between a locking head 551 of the control means 5 and an upper notch 15 when the locking head 551 is locked in the grip 12 when closing the umbrella.

The bottom plug 120 includes: a central hole 120*b* for a sliding movement of the elongate cylinder 571 within the central hole 120*b* and allowing a downward movement of the tubes of the shaft 1 to depress the elongate cylinder 571 downwardly and to engage the locking head 551 with an engaging hole 111*b* formed in a bottom sleeve 11*a* jacketed in the lower tube 11 secured in a bottom portion of the plug 120 when closing the umbrella; with a spring plate 58 secured on the bottom sleeve 11*a* for resiliently guiding the locking head 551 to be engaged with the engaging hole 111*b* in the bottom sleeve when closing the umbrella. The opening spring 3 has its lower end 31 retained in a lower portion of the shaft 1.

For closing the umbrella, the push button 51 is depressed to inwardly thrust the ring member 511 and the lower latch 54 through a hole formed in the lower tube 11 to disengage the locking head 551 from the engaging hole 111*b* to release the tension force on the rope 56 and the opening spring 3, the closing springs 4 will restore to retract the rib assembly 2 for closing the umbrella. For opening the umbrella, the push button 51 is depressed to disengage the upper latch 52 from the engaging hole 100 in the tubes, the opening spring 3 will extend the tubes of the shaft 1 and the rib assembly 2 for opening the umbrella.

When closing the umbrella (FIG. 1), the inner rope end 561 of the rope 56 is secured to the locking head 551 (as downwardly pushed by the central sleeve 17*a* to be locked at the engaging hole 111*b*) and the rope 56 is then directed upwardly to be wound on a first guiding roller R1 pivotally mounted on a top portion of the central shaft 1 adjacent the upper notch 15 to form a first "rope section" S1 (between inner rope end 561 and the first guiding roller R1); with the rope 56 downwardly directed from the first guiding roller R1 to be wound about a second guiding roller R2 pivotally mounted in the lower runner 23 to form a second rope section S2; with the rope then directed upwardly from the second guiding roller R2 to be wound on a third guiding roller R3 pivotally mounted on the top portion of the shaft 1 adjacent the upper notch 15 to form a third rope section S3; with the rope led downwardly from the third guiding roller R3 to be wound about a fourth guiding roller R4 pivotally mounted on the lower runner 23 to form a fourth rope section S4; and finally with the rope directed from the fourth guiding roller R4 upwardly to the upper notch 15 to form the fifth rope section S5, thereby forming a rope 56 of penta-fold rope provided for multiple-fold automatic umbrella including quadruple-fold umbrella.

The first and third guiding rollers R1, R3 are respectively pivotally (or rotatably) mounted (or secured) in a top portion of the shaft 1 or in an upper notch 15. Preferably the first and third guiding rollers R1, R3 are pivotally mounted in an upper roller holder 6 which is embedded or formed in a top portion (or upper notch 15) of the central shaft 1.

The second and fourth guiding rollers R2, R4 are respectively pivotally mounted in the lower runner 23; and preferably pivotally secured in a lower roller holder 7 which is then embedded or formed in the lower runner 23.

The upper roller holder 6 includes: a pair of lugs 61, 62 diametrically or oppositely formed on an upper portion of the upper roller holder 6 to be engaged with a pair of notches 141, 142 diametrically recessed in a top portion of the upper tube 14; a first roller cavity 63 recessed in the upper roller holder 6 for pivotally securing the first guiding roller R1 therein; and a third roller cavity 64 recessed in the upper roller holder 6 for pivotally securing the third guiding roller R3 therein; with a rope hole formed through the roller holder 6 for passing the rope 56 therethrough; and having a rope guide 630 formed on a lower portion of the first roller cavity 63 for guiding the rope 56 from the first guiding roller R1 downwardly towards the second guiding roller R2.

The first and third guiding rollers R1, R3 may be coaxially pivotally secured on a pivot P having opposite pivot end portions P' embedded and fixed in a pair of pivot holes 631, 641 respectively formed aside the first and third roller cavities 63, 64.

Each pivot end portion P' may be formed as a square or rectangular shape to be firmly secured into the square or rectangular pivot holes 631 or 641. Other fixing methods such as by adhesive bonding may be applied to further firmly fix the pivot P in the pivot holes 631, 641.

The lower roller holder 7 includes: a holding block 71 having a pair of lugs 74 oppositely formed on the holding block 71 to be respectively engaged with two lug holes 234 respectively formed on a pair of side plates 233 juxtapositionally formed on the lower runner 23; a second roller cavity 72 recessed in the holding block 71 for pivotally securing the second guiding roller R2 in the second roller cavity 72; a fourth roller cavity 77 recessed in the holding block 71 for pivotally securing the fourth guiding roller R4 in the fourth roller cavity 77; a pivot 73 secured in the holding block 71 for pivotally mounting the second and fourth guiding rollers R2, R4 on the pivot 73, with the holding block 71 snugly rested on a base 235 formed in the lower runner 23 between the two side plates 233; an extending arm 75 protruding downwardly from the holding block 71 to be engaged with a recess 231*a* formed in the lower runner 23 under the base 235 having a groove 76 arcuately recessed in the extending arm 75 to be engaged with a fastening wire 232 provided for fastening a ferrule 231 of the lower runner 23, thereby fastening the extending arm 75 and the lower roller holder 7 stably on the lower runner 23 for well protecting the guiding rollers R2, R4 in the lower holder 7.

The pivot 73 has its opposite ends 731 formed as square or rectangular shape to be firmly fixed into two pivot holes 720, 770 formed in the holding block 71 of the lower holder 7. The holding block 71 is also formed with rope holes 711, 712 therein to smoothly pass the rope 56 through the rope holes.

The mounting locations, orientations, and methods of the guiding rollers R1~R4 respectively in the upper notch 15 or in the lower runner 23 are not limited in the present invention and may be modified by those skilled in the art. For example, the second and fourth rollers R2, R4 may also be respectively pivotally secured in the lower runners by two pivots differently positioned on the runner 23.

The rope sections S1~S5 of the rope 56 of the present invention are symmetrically disposed on opposite sides of the guiding rollers R1~R4 to provide a smooth strokes of the rope when extending or retraction of the rib assembly 2 for opening or closing the umbrella, thereby enhancing a smooth ergonomic dynamic-balance operation of the automatic umbrella. The roller holders 6, 7 can be detachably secured on the umbrella for easy assembly and maintenance of the umbrella. The rope 56 can be conveniently wound on the rollers for facilitating the production of the umbrella.

Another preferred embodiment of the present invention is shown in FIGS. 6~12 in which the rope 56 is modified to include the following rope sections:

S1 . . . the first rope section from the inner rope end 561 secured to the locking head 551 to the first guiding roller R1 pivotally mounted in the upper roller holder 6 formed in the upper portion of the shaft 1 adjacent to the upper notch 15;

S2 . . . the second rope section from the first guiding roller R1 to the second guiding roller R2 pivotally mounted in the lower roller holder 7 formed in the lower runner 23;

S3 . . . the third rope section from the second guiding roller R2 to be wound on the third and fourth guiding rollers R3, R4 respectively pivotally mounted in the upper roller holder 6; and S4 . . . the fourth rope section from the third and fourth rollers R3, R4 to pass across the diameter of the upper tube 14 of the shaft 1 to an outer rope end 562 downwardly fixed to the lower runner 23 opposite to the second guiding roller R2.

If the fourth rope section S4 is then continuously wound from the lower runner 23 about a further roller (not shown) to be upwardly secured to the upper notch 15, a fifth rope section will be formed to be a penta-fold rope, which may be modified by those skilled in the art. The roller holders 6, 7 may be further modified, not limited to the embodiments as shown in the drawing figures.

Accordingly, the rope sections S1~S5 of the rope 56 are also symmetrically disposed about the central shaft 1 for dynamically balancing strokes of the rope for well guiding the rope and for smoothly operating the umbrella of the present invention.

The rollers R1~R4 are respectively mounted in upper and lower roller holders 6, 7 which can be easily conveniently mounted in (or detached from) the shaft 1 and runner 23 for facilitating the production and maintenance of the umbrella.

The upper roller holder 6 includes: a pair of lugs 61, 62 diametrically formed on an upper portion of the upper roller holder 6 to be engaged with a pair of notches 141, 142 diametrically recessed in a top portion of the upper tube 14; a first roller cavity 63 recessed in the upper roller holder 6 for pivotally securing the first guiding roller R1 therein; a third and fourth roller cavities 64, 65 respectively recessed in the upper roller holder 6 for pivotally securing the third and fourth guiding roller R3, R4 therein; with a rope hole 60 formed through the roller holder 6 for passing the rope 56 therethrough; and having a rope guide 634 formed on a lower portion of the first roller cavity 63 for guiding the rope 56 from the first guiding roller R1 downwardly towards the second guiding roller R2.

The third and fourth guiding rollers R3, R4 may be respectively pivotally secured on two pivots 642, 652 each pivot 642 or 652 having opposite pivot end portions 643 or 653 embedded and fixed in two pivot holes 641 or 651 respectively formed in the third and fourth roller cavities 64, 65. Each pivot end portion 643 or 653 may be formed as square or rectangular shape to be firmly fixed into each pivot hole 641 or 651.

The two lugs 61, 62 are further formed with two side rope guide grooves 611, 621 therein and an upper rope guide groove 66 recessed in the upper portion of the upper roller holder 6 for smoothly guiding the rope 56 across the third and fourth rollers R3, R4 from the third rope section S3 to the fourth rope section S4 disposed on opposite sides of the third and fourth guiding rollers R3, R4.

The lower roller holder 7 includes: a holding block 71 having a pair of lugs 74 oppositely formed on the holding block 71 to be respectively engaged with two lug holes 234 respectively formed on a pair of side plates 233 juxtapositionally formed on the lower runner 23; a second roller cavity 72 recessed in the holding block 71 for pivotally securing the second guiding roller R2 in the second roller cavity 72; a pivot 73 secured in the holding block 71 for pivotally mounting the second guiding rollers R2 on the pivot 73, with the holding block 71 snugly rested on a base 235 formed in the lower runner 23 between the two side plates 233; an extending arm 75 protruding downwardly from the holding block 71 to be engaged with a recess 231*a* formed in the lower runner 23 under the base 235 having a groove 76 arcuately recessed in the extending arm 75 to be engaged with a fastening wire 232 provided for fastening a ferrule 231 of the lower runner 23, thereby fastening the extending arm 75 and the lower roller holder 7 stably on the lower runner 23 for well protecting the guiding rollers R2 in the lower holder 7. The roller R2 may be detachably mounted into the block 71 through a pair of side holes 721 of the cavity 72.

Figure 6:
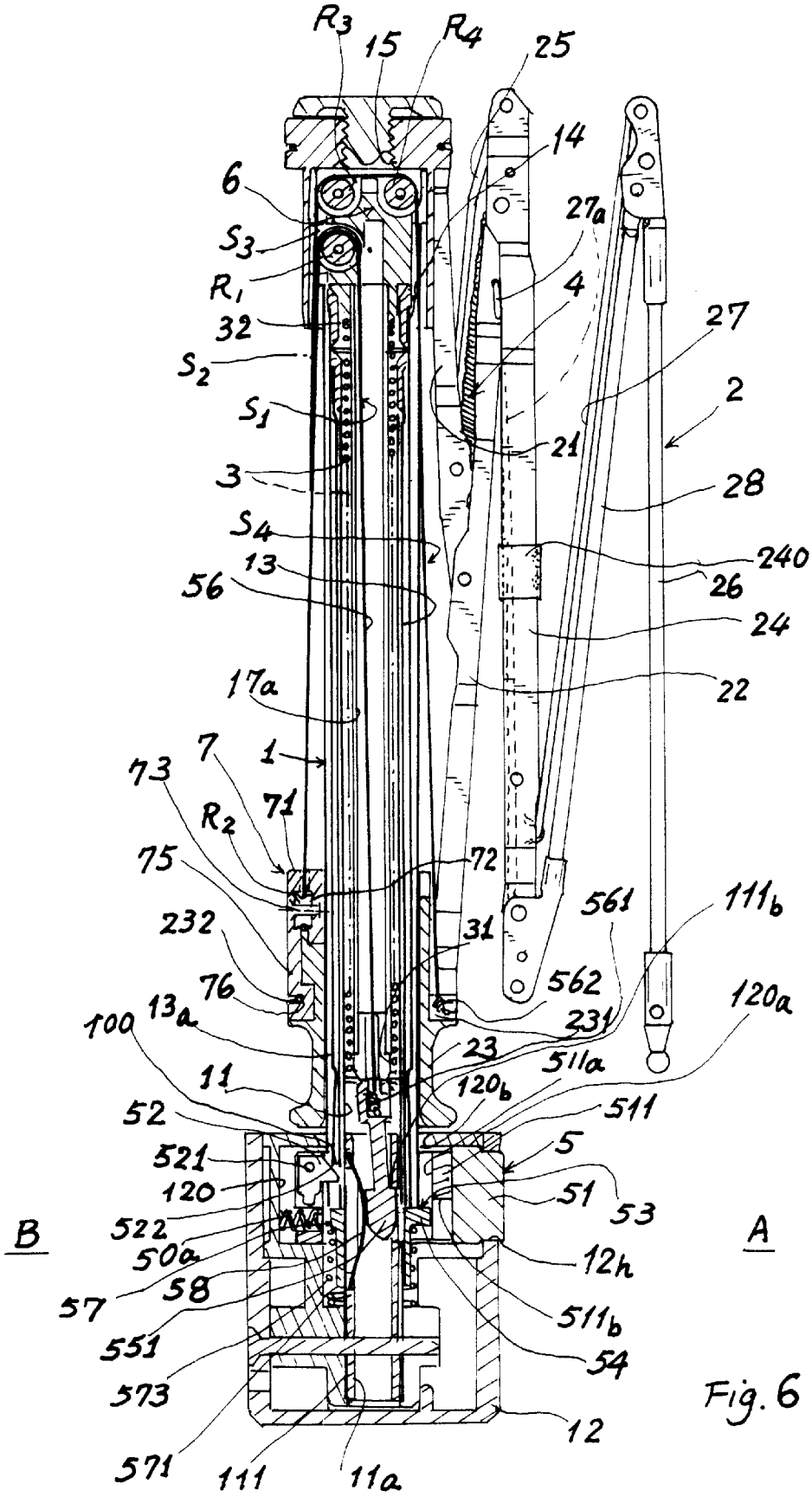
FIG. 6 is an illustration of another preferred embodiment of the present invention when closed.
Figure 7:
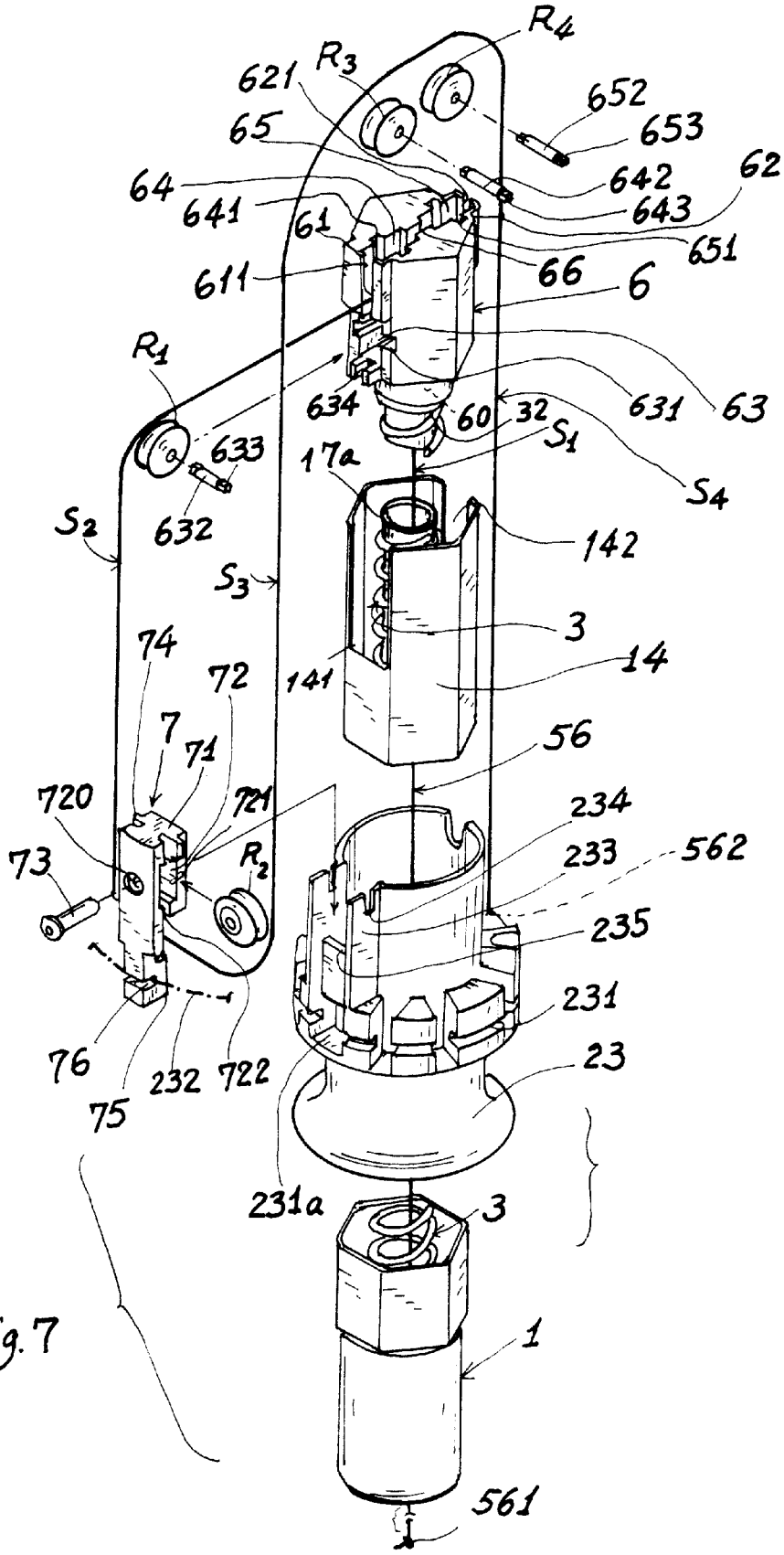
FIG. 7 is an exploded view of the rope, rollers, and roller holders of the embodiment of FIG. 6.
Figure 8:
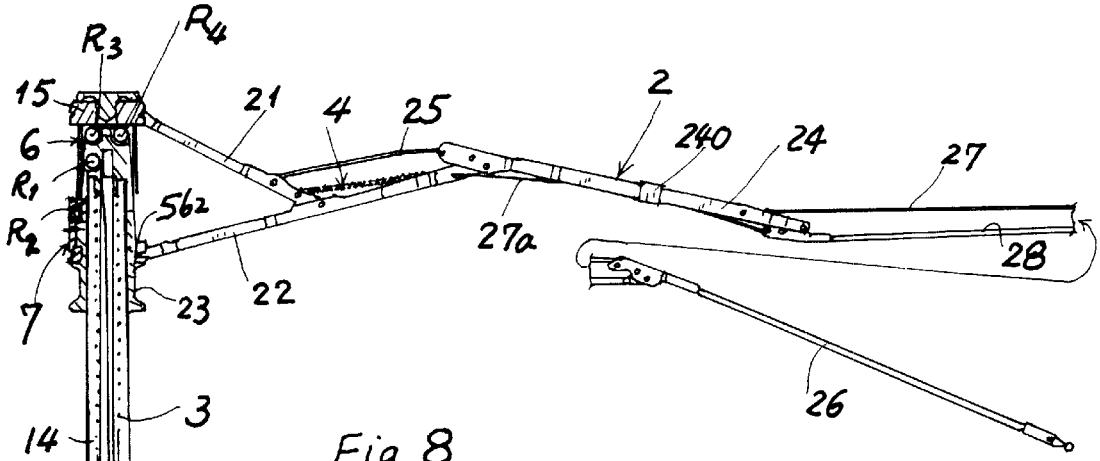
FIG. 8 is an illustration when opening the umbrella of FIG. 6.
Figure 9:
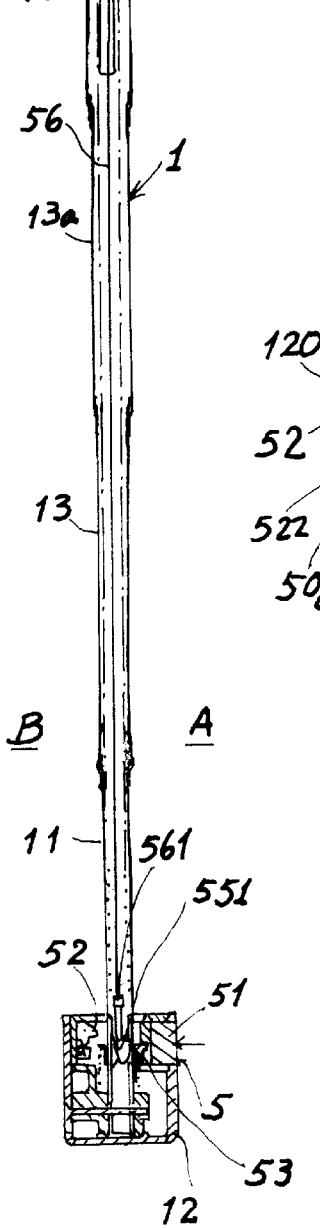
FIG. 9 is a sectional drawing when releasing the depression of push button from FIG. 8.
Figure 9:
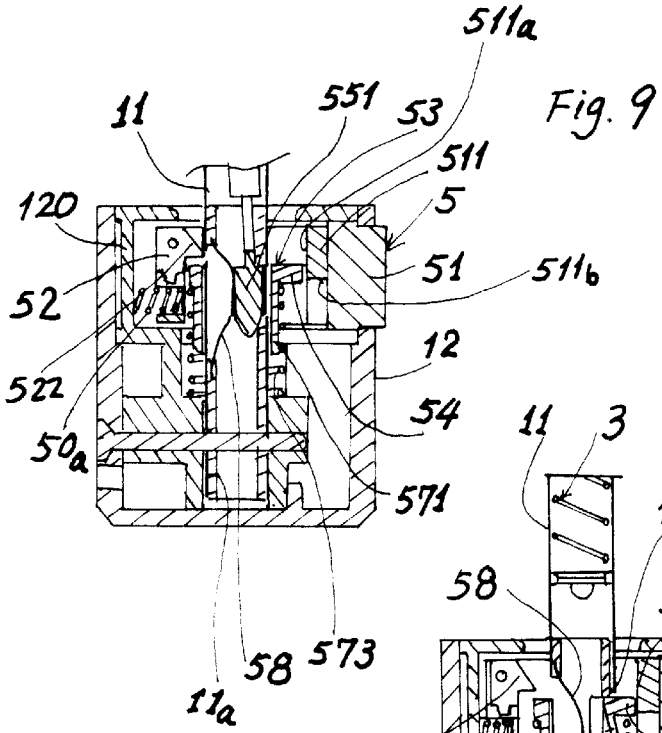
Figure 10:
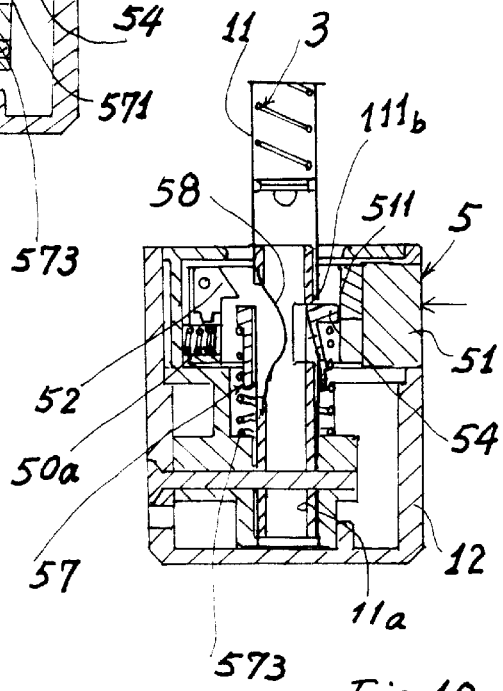
FIG. 10 shows the depression of the push button for closing the umbrella from its opening state.

For opening the umbrella, the push button 51 is depressed to disengage the upper latch 52 from the tubes of the shaft 1 and the opening spring 3 will extend the tubes and rib assembly 2 to open the umbrella from FIG. 6 to FIG. 8.

For closing the umbrella, the push button 51 is depressed to disengage the locking head 551 from the hole 111*b* to release the tension of the rope 56 and the opening spring 3 to allow the closing springs 4 to close the umbrella. After opening the umbrella (FIG. 8), the lower latch 54 will be raised by the spring 573 (FIG. 9) to align the lower latch 54 with the push button 51 through the sliding ring member 511, thereby allowing a depression of the lower latch 54 by the push button 51 for closing the umbrella (from FIG. 9 to FIG. 10).

The central shaft 1, the rib assembly 2, the springs 3, 4 and the control means 5 may be referred to that as shown in FIGS. 1~5. The shapes of the cross section of the tubes are not limited in the present invention. For instance, the lower tube 11 may have a cross section of circular shape; the first middle tube 13 having hexagonal shape; the second middle tube 13*a* having circular shape; and the upper tube 14 having hexagonal shape. The cross section of the outer connecting rib 28 has a convex upper surface and a concave bottom surface and may be made of fiber-reinforced plastic materials.

Figure 11:
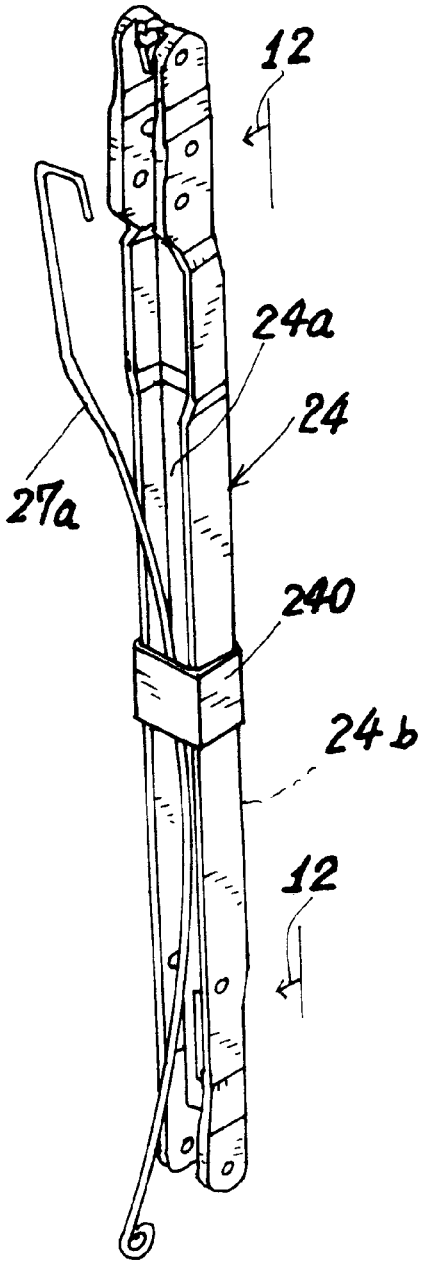
FIG. 11 is a perspective view of an intermediate rib of the present invention of FIG. 6.
Figure 12:
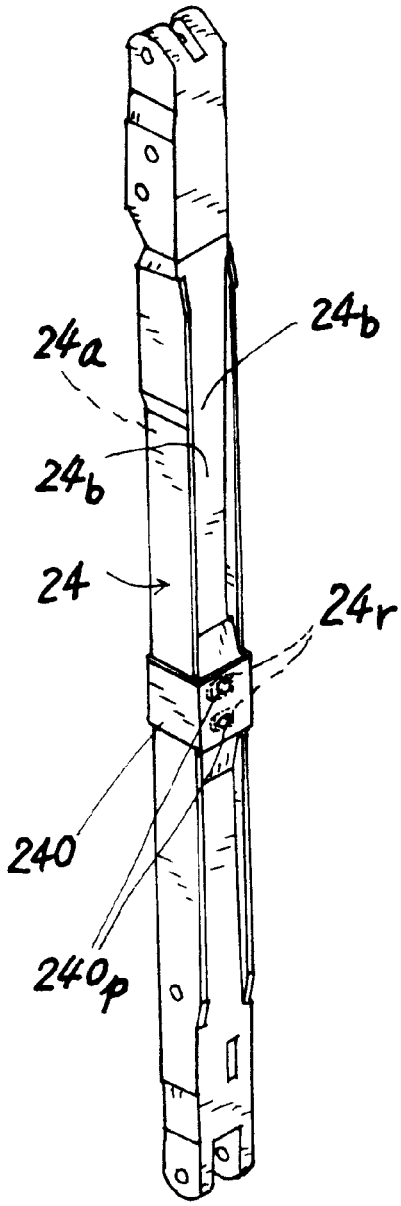
FIG. 12 shows the intermediate rib from 12—12 direction of FIG. 11.

As shown in FIGS. 11, 12, the rib assembly 2 of the present invention includes: an intermediate rib 24 pivotally connected between inner ribs (including ribs 22, 25, 21) and outer ribs (including ribs 28, 27, 26) of the rib assembly 2, with the intermediate rib 24 made of plastic materials having a cross section of H shape and including a first elongate groove 24*a* for slidably holding an inner spring rib 27*a* pivotally connected between the inner and outer ribs and juxtpositioned to the intermediate rib 24 by a ring 240 secured on a middle portion of the intermediate rib 24, and a second elongate groove 24*b* opposite to the first elongate groove 24*a* having a middle extension formed with two recesses 24*r* therein to be engaged with two protrusions 240*p* formed on the ring 240 for engaging the ring 240 on the middle extension of the intermediate rib 24 (FIG. 12).

The present invention may be modified without departing from the spirit and scope of the present invention.

We claim:

1. A multiple-fold automatic umbrella comprising:

a central shaft consisting of a plurality of tubes telescopically engagable with one another, having an upper notch formed on a top portion of the shaft and a lower runner slidably held on the shaft;

a rib assembly pivotally connected between the upper notch and the lower runner;

an opening spring retained in the shaft for opening the umbrella;

a plurality of closing springs retained on the rib assembly for closing the umbrella; and a control means including a push button slidably held in a grip, an opening controller including an upper latch formed in the grip and operatively depressed by said push button for extending said tubes of said shaft and said rib assembly for opening the umbrella, and a closing controller including a lower latch formed in the grip and operatively depressed by said push button for unlocking a locking head for closing the umbrella from an opened umbrella, and said locking head secured with a multiple-fold rope including a first rope section from an inner rope end, secured to said locking head locked in a lower portion of said shaft when closing the umbrella, to a first guiding roller pivotally mounted in the top portion of the first guiding roller to a second guiding roller pivotally mounted on the lower runner; a third rope section from the second guiding roller to a third guiding roller pivotally mounted in the top portion of the shaft;

a fourth rope section from the third guiding roller to a fourth guiding roller pivotally mounted on the lower runner; and a fifth rope section from the fourth guiding roller to an outer rope end secured in the upper notch; said first and third guiding rollers pivotally mounted in an upper roller holder formed in the top portion of the shaft; and said second and fourth guiding rollers pivotally mounted in a lower roller holder formed in the lower runner;

said upper roller holder including a pair of lugs diametrically or oppositely formed on an upper portion of the upper roller holder to be engaged with a pair of notches diametrically recessed in a top portion of the upper tube; a first roller cavity recessed in the upper roller holder for pivotally securing the first guiding roller therein; and a third roller cavity recessed in the upper roller holder for pivotally securing the third guiding roller therein; having at least a rope hole formed through the roller holder for passing the rope therethrough;

said first and third guiding rollers coaxially pivotally secured on a pivot having opposite pivot end portions embedded and fixed in a pair of pivot holes formed in the upper roller holder; and said lower roller holder including: a holding block having a pair of lower lugs oppositely formed on the holding block to be respectively engaged with two lug holes respectively formed in a pair of side plates juxtapositionally formed on the lower runner; a second roller cavity recessed in the holding block for pivotally securing the second guiding roller in the second roller cavity; a fourth roller cavity recessed in the holding block for pivotally securing the fourth guiding roller in the fourth roller cavity; a lower pivot secured in the holding block for pivotally mounting the second and fourth guiding rollers on the lower pivot, with the holding block snugly rested on a base formed in the lower runner between the two side plates; an extending arm protruding downwardly from the holding block to be engaged with a recess formed in the lower runner under the base having a groove arcuately recessed in the extending arm to be engaged with a fastening wire provided for fastening a ferrule of the lower runner for fastening the extending arm and the lower roller holder stably on the lower runner for well protecting the second and fourth guiding rollers in the lower holder.

* * * * *